United States Patent [19]

Frosch et al.

[11] Patent Number: 4,858,276

[45] Date of Patent: Aug. 22, 1989

[54] UNIVERSAL TEXTILE MACHINE FOR OPTIONALLY MANUFACTURING LONGITUDINALLY AND/OR RANDOMLY ORIENTED FIBER FLEECE

[75] Inventors: Werner Frosch, Schwanewede; Wolfram Dudek, Dülmen, both of Fed. Rep. of Germany

[73] Assignee: Hollingsworth GmbH, Neubulach, Fed. Rep. of Germany

[21] Appl. No.: 25,245

[22] Filed: Mar. 12, 1987

[30] Foreign Application Priority Data

Sep. 24, 1986 [DE] Fed. Rep. of Germany ..... 3632483

[51] Int. Cl.[4] ..... D01G 15/26

[52] U.S. Cl. ..... 19/98; 19/106 R

[58] Field of Search ..... 19/98, 106 R

[56] References Cited

U.S. PATENT DOCUMENTS 4,651,386 3/1987 Frosch ..... 19/106 R

*Primary Examiner*—Louis K. Rimrodt

*Attorney, Agent, or Firm*—Townsend and Townsend

[57] ABSTRACT

A carding machine is provided with two doffer units. Each doffer unit comprises a doffer roller and an intermediate roller coordinated thereto, which rollers are shiftable into two different operating positions. In a first operating position, the intermediated roller is out of operation and the doffer roller works in a usual manner in combination with the main cylinder. In the second operating position the doffer roller is out of operational contact with the main cylinder and the intermediate roller, which has the same direction of rotation as the main cylinder, is positioned so as to transfer the fibers from the main cylinder to the doffer roller. The fiber fleeces leaving each of the doffer units may be combined to form a compound fiber fleece. In order to form a thin single layer fiber fleece, one of the intermediate rollers in said second operating position is driven with the speed of rotation such that its circumferential speed is lower than the circumferential speed of the coordinated doffer roller, thus preventing the transfer of fibers from the main cylinder to the doffer roller.

11 Claims, 2 Drawing Sheets

UNIVERSAL TEXTILE MACHINE FOR OPTIONALLY MANUFACTURING LONGITUDINALLY AND/OR RANDOMLY ORIENTED FIBER FLEECE

BACKGROUND OF THE INVENTION

The invention relates to a universal textile or carding machine for selectively producing either a longitudinally oriented fiber fleece, a tangle-fibered fleece, or a mixture of both such fleeces.

A universal textile machine for selectively producing either longitudinally oriented webs or tangled webs is already known (DE-OS No. 35 10 951.3-26). Such a textile machine comprises a main cylinder and carding elements cooperating therewith, a fiber drawing-in device and a doffer, whose card clothings adjoin the circumferential area of the main cylinder, and further comprises a supplementary intermediate roller furnished with a card clothing and the shaft of which may be positioned into a first or a second position by a setting mechanism for adjusting the distance between the doffer roller and the main cylinder, by selecting the position such that when the doffer roller is put into its operating position, the card clothing of the intermediate roller is out of operational engagement relative to the card clothings of the main cylinder and of the doffer roller, and that in the second position, when the doffer roller is operationally separated from the main cylinder, the card clothing of the intermediate roller is in its operating position both relative to the card clothing of the main cylinder and of the doffer roller. The main cylinder and the intermediate roller have the same direction of rotation.

Depending on the correlated position of the intermediate roller and of the doffer roller, either longitudinally fibered or tangle-fibered fleeces may be produced.

The known textile machine further comprises a second doffer roller and coordinated intermediate roller similar in operation to the first doffer roller and coordinated intermediate roller. Each of the doffer units may be set to the production either of a longitudinally oriented or a tangled fleece. The fleece manufactured by such a textile machine is a combination of the fleeces leaving the doffer units. However, sometimes it is desirable to manufacture thin fleeces, and manufacturing such a fleece with a known textile machine afforded the disassembly of one of the doffer units, which is time-consuming and cumbersome.

BRIEF SUMMARY OF THE INVENTION

It is an object of the invention to improve the aforementioned textile machine such that a thin, uniform fleece may be manufactured without disassembling one of the doffer units.

This and other objects are achieved by the feature that at least one of said intermediate rollers of said doffer units is adjustable to a speed of rotation such that its circumferential speed is lower than the circumferential speed of the coordinated doffer roller.

Preferably, the rotational speed of the adjustable intermediate roller may be adjustable to several individual speeds or may be continuously variable, in order to adapt the speed of rotation to the kind and composition of fibers.

BRIEF DESCRIPTION OF THE DRAWINGS

The invention is further described with reference to the accompanying drawings which illustrate a preferred embodiment by way of example and in which.

DETAILED DESCRIPTION OF A PREFERRED EMBODIMENT

Figure 1:
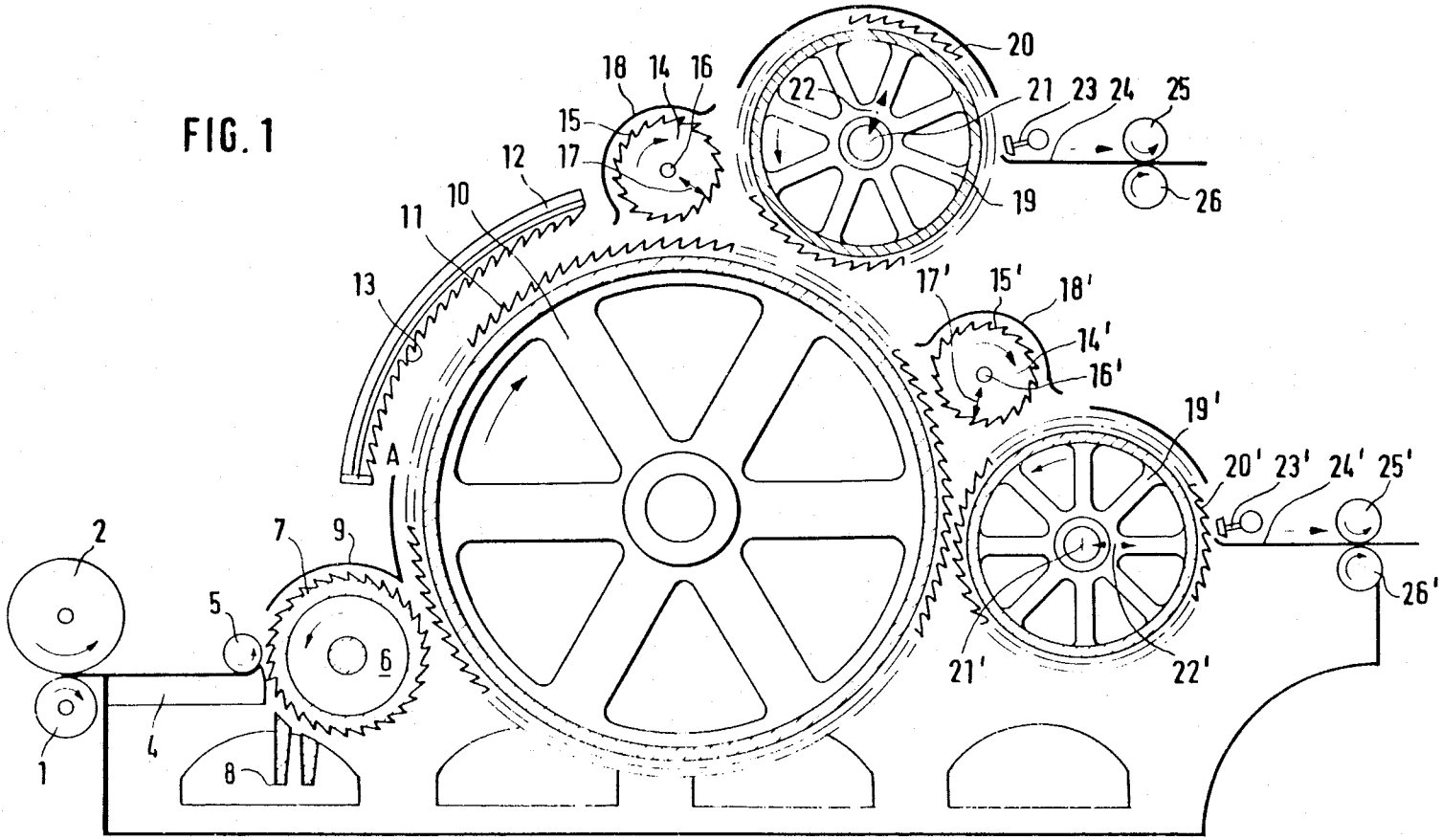
FIG. 1 is a vertical section through a universal machine.

In the drawings the same components are given the same reference numerals, those referring to the components of the second doffer being given an apostrophe.

The universal textile machine as shown in FIG. 1 comprises a fiber drawing-in mechanism consisting of a table 4, adjacent to which is a grooved roller 1, which butts against a fiber lap 2. The sheet of fibers released from the lap 2 is drawn across the table 4 by a feed roller 5 and let to a licker-in 6, the surface of which is provided with a toothed clothing, which catches in the fiber layer and tears fibers of fiber flocks out of it and passes them onto the main cylinder 10. Only long fibers are transferred, while short fibers and waste particles are removed from the stripping blades 8 in combination with the centrifugal force of the licker-in 6.

The teeth 11 of the card clothing of the main cylinder 10 take over the fibers from the licker-in 6, as the circumferential velocity of this main cylinder is greater than that of the licker-in 6.

Part of the circumference of the main cylinder 10 is covered by a stationary carding flat 12, the teeth 13 of which are positioned at a small clearance from the teeth 11 of the main cylinder. In FIG. 1 the clearance between the carding flat 12 on the one hand and the main cylinder 10 on the other hand has been exaggerated for the sake of clarity.

Alternatively, other carding means can be provided instead of the carding flat, for instance worker rollers, revolving carding flats etc.

After leaving the space between the main cylinder 10 and the carding flat 12, the fibers are picked up by the doffer 19 and stripped off therefrom by a stripper 23 located at the delivery end of the doffer 19 and thereafter are removed from the machine as a fiber fleece 24 by calendar rollers 25 and 26. The shaft 21 of the doffer roller 19 may be adjustable in the direction as indicated by the double arrow 22.

Upstream of the fiber flow round the main cylinder 10 in a region adjacent the circumference of the main cylinder 10 on the one hand and the doffer roller 19 on the other hand a first intermediate roller 14 is positioned, which is also provided with a saw-tooth wire clothing or fillet 15 and which is partially surrounded by an arcuate cover 18 located close to but at a small distance from the sawtooth wire clothing 15 and extending over the outwardly facing peripheral region of the first intermediate roller 14. The intermediate roller 14 and the associated cover 18 are shiftable or adjustable in the direction of the double arrow 17.

The first doffer roller 19 is shiftable or adjustable in the direction of the double arrow 22.

In the direction of rotation of the main cylinder 10 downstream of the first doffer roller 19 there is provided a second doffer unit similar to the first doffer unit and comprising a second doffer roller 19' and a coordinated second intermediate roller 14'. Identical parts in the second doffer unit have been indicated by the addition of an apostrophe to the corresponding reference numerals.

The fiber fleeces leaving the first pair of calendar rollers 25, 26 and the second pair of calendar rollers 25', 26' may be combined to a compound fleece.

Figure 2:
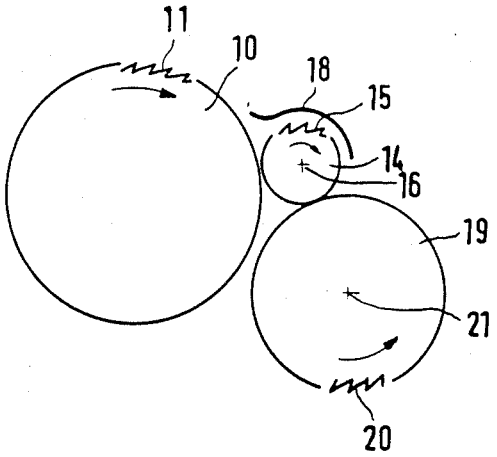
FIG. 2 is a schematical view illustrating the position of the rollers of a doffer unit for producing a tangled fleece.
Figure 3:
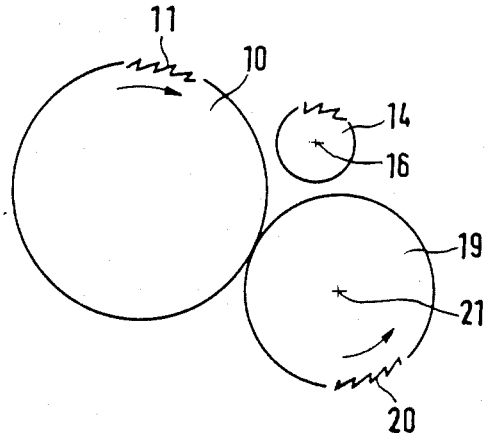
FIG. 3 is a schematical view illustrating the position of the rollers of a doffer unit for producing a longitudinally oriented fleece.

The doffer rollers 19, 19' on the one hand and the coordinated intermediate rollers 14, 14' on the other hand may be shifted in a correlated manner into two end positions shown schematically in FIGS. 2 and 3.

In the relative position of the rollers shown in FIG. 1 and schematically in FIG. 3, the intermediate roller 14 is in an inoperative position, in which it does not affect the transfer of the fibers from the main cylinder 10 to the doffer roller 19. On the other hand, the doffer roller 19 is in such close proximity to the main cylinder 10, that it takes over at least part of the fibers from the main cylinder. In such an operating position or setting, the resulting fiber fleece consists mainly of longitudinally oriented or parallel fibers.

In the second one of the operating positions, which is shown schematically in FIG. 2, the doffer roller 19 is located at such a clearance from the main cylinder that no transfer of fibers from the main cylinder 10 to the doffer roller 19 can occur. However, the intermediate roller 14 is shifted to its end position, in which it is in operational contact with the main cylinder 10 on the one hand and the doffer roller 19 on the other hand, so that the fibers are transferred from the main cylinder 10 to the intermediate roller 14 and thereafter from the latter to the doffer roller 19. The same applies for the second doffer unit comprising the second intermediate roller 14' and the second doffer roller 19'.

As may be seen from FIG. 1, the main cylinder 10 and the intermediate rollers 14, 14' rotate in the same, clockwise direction, whereas the doffer rollers 19, 19' rotate in the opposite, counterclockwise direction.

In the aforementioned embodiment the circumferential velocity of the main cylinder is 1000 m/min and the circumferential velocity of the intermediate rollers is about 800 m/min, whereas the doffer rollers 19, 19' are rotating with a circumferential speed of 100 m/min.

In order to manufacture a fleece of a single layer, for instance by use of the doffer unit 14, 19, the second doffer unit 14', 19' need not be disassembled. Instead and in conformity with the invention, the speed of the intermediate roller 14' is reduced to an extent that its circumferential speed is lower than the circumferential speed of doffer roller 19', i.e. lower than 100 m/min. By this the second doffer unit when set to the operating position as shown in FIG. 2 is rendered ineffective, since no fibers are taken off from the main drum.

The first doffer unit comprising the intermediate roller 14 and the doffer roller 19 may be brought in either of the operating positions shown in FIG. 2 and FIG. 3. Thus, a longitudinally oriented or a tangled single layer fiber fleece may be manufactured.

We claim:

1. A universal textile machine for selectively producing longitudinally oriented fiber fleece and/or tangled fiber fleece, comprising a main cylinder and carding elements cooperating therewith, a fiber drawing-in device and a first doffer roller, whose card clothings adjoin the circumferential area of the main cylinder, a first intermediate roller provided with a card clothing and the shaft of which is adapted to be positioned into a first or a second position by an adjusting device for adjusting the distance between the first doffer roller and the main cylinder, wherein said positions are selected such that when the first doffer roller is put into its operating position relative to the main cylinder, the card clothing of the first intermediate roller is out of operational engagement relative to the card clothings of both the main cylinder and the first doffer roller, and that in said second position, when the first doffer roller is operationally separated from the main cylinder, the card clothing of the first intermediate roller is in its operating position both relative to the card clothing of the main cylinder and of the first doffer roller, wherein the main cylinder and the first intermediate roller have the same direction of rotation, further comprising a second doffer roller, which is located downstream of the first doffer roller along the direction of the fiber flow around the main cylinder, and a second intermediate roller coordinated to said second doffer roller, said second rollers being similar in construction, arrangement and adjustability to said first intermediate roller and doffer roller and a device for combining the individual fleeces leaving each of said doffer rollers, wherein at least one of said intermediate rollers is adjustable to a speed of rotation such that its circumferential speed is lower than the circumferential speed of the coordinated doffer roller.

2. A universal textile machine as claimed in claim 1, wherein the speed of rotation of the adjustable intermediate roller is adjustable to a plurality of discrete speeds.

3. A universal textile machine as claimed in claim 1, wherein the speed of rotation of the adjustable intermediate roller is continuously adjustable.

4. A universal textile machine for selectively producing longitudinally oriented fiber fleece and/or tangled fiber fleece, comprising:

a main cylinder having card clothing disposed on a circumferential area thereof for receiving fibers from a fiber drawing-in mechanism;

a first doffer roller having card clothing disposed on a circumferential area thereof for operationally adjoining the circumferential area of the main cylinder;

a first intermediate roller having card clothing disposed on a circumferential area thereof, the main cylinder and the first intermediate roller having the same direction of rotation;

first adjusting means for adjusting the relative positions of the main cylinder and the first doffer roller from a first position wherein the main cylinder operationally adjoins the first doffer roller to a second position wherein the main cylinder is spaced apart from the first doffer roller, the first adjusting means including shifting means for shifting the first intermediate roller from a first position therein the first intermediate roller operationally adjoins both the first doffer roller and the main cylinder when the first doffer roller and the main cylinder are separated from each other, to a second position wherein the first intermediate roller is spaced apart from both the main cylinder and the first doffer roller when the first doffer roller operationally adjoins the main cylinder; and first rotational speed adjusting means for adjusting the rotational speed of the first intermediate roller so that a circumferential speed of the first intermediate roller is slower than a circumferential speed of the first doffer roller.

5. The textile machine according to claim 4 wherein the rotational speed adjusting means adjusts the rotational speed of the first intermediate roller to one of a plurality of discrete speeds.

6. The textile machine according to claim 4 wherein the rotational speed adjusting means adjusts the rotational speed of the first intermediate roller to a speed within a continuous range.

7. The textile machine according to claim 4 wherein the first rotational speed adjusting means adjusts the rotational speed of the first intermediate roller so that a circumferential speed of the first intermediate roller is slower than a circumferential speed of the first doffer roller when the first intermediate roller operationally adjoins both the main cylinder and the first doffer roller.

8. The textile machine according to claim 4 further comprising:

a second doffer roller having card clothing disposed on a circumferential area thereof for operationally adjoining the circumferential area of the main cylinder;

a second intermediate roller having card clothing disposed on a circumferential area thereof, the main cylinder and the second intermediate roller having the same direction of rotation; and second adjusting means for adjusting the relative positions of the main cylinder and the second doffer roller from a first position wherein the main cylinder operationally adjoins the second doffer roller to a second position wherein the main cylinder is spaced apart from the second doffer roller, the second adjusting means including shifting means for shifting the second intermediate roller from a first position wherein the second intermediate roller operationally adjoins both the second doffer roller and the main cylinder when the second doffer roller and the main cylinder are separated from each other, to a second position wherein the second intermediate roller is spaced apart from both the main cylinder and the second doffer roller when the second doffer roller operationally adjoins the main cylinder.

9. The textile machine according to claim 8 further comprising:

second rotational speed adjusting means for adjusting the rotational speed of the second intermediate roller so that a circumferential speed of the second intermediate roller is slower than a circumferential speed of the second doffer roller.

10. The textile machine according to claim 9 wherein the second rotational speed adjusting means adjusts the rotational speed of the second intermediate roller so that a circumferential speed of the second intermediate roller is slower than a circumferential speed of the second doffer roller when the second intermediate roller operationally adjoins both the main cylinder and the second doffer roller.

11. The textile machine according to claim 10 further comprising:

means for combining the individual fleeces leaving each of the first and second doffer rollers.

* * * * *